US012054963B2

(12) United States Patent
Bina et al.

(10) Patent No.: US 12,054,963 B2
(45) Date of Patent: Aug. 6, 2024

(54) THREE-DIMENSIONAL PARKING SYSTEM

(71) Applicant: Pathway Automatic Parking (Beijing) Co., Ltd., Beijing (CN)

(72) Inventors: Michele Alessandro Bina, Beijing (CN); Gang Yang, Beijing (CN); Guannan Hu, Beijing (CN)

(73) Assignee: Pathway Automatic Parking (Beijing) Co. Ltd., Beijing (CN)

( * ) Notice: Subject to any disclaimer, the term of this patent is extended or adjusted under 35 U.S.C. 154(b) by 0 days.

(21) Appl. No.: 17/916,536

(22) PCT Filed: Oct. 11, 2021

(86) PCT No.: PCT/CN2021/123060
§ 371 (c)(1),
(2) Date: Sep. 30, 2022

(87) PCT Pub. No.: WO2023/060388
PCT Pub. Date: Apr. 20, 2023

(65) Prior Publication Data
US 2024/0133201 A1 Apr. 25, 2024

(51) Int. Cl.
*E04H 6/22* (2006.01)

(52) U.S. Cl.
CPC ..... *E04H 6/22* (2013.01)

(58) Field of Classification Search
CPC ..... E04H 6/22; E04H 6/28; E04H 6/282
(Continued)

(56) References Cited

U.S. PATENT DOCUMENTS 2,849,127 A * 8/1958 Densmore ..... E04H 6/28 D25/5
3,405,816 A * 10/1968 Beau ..... E04H 6/28 414/254
3,985,243 A * 10/1976 Kuhner ..... E04H 6/26 414/242

FOREIGN PATENT DOCUMENTS

CN 108442780 A 8/2018
CN 108979246 A 12/2018
(Continued)

OTHER PUBLICATIONS

ISA/CN, "International Search Report Regarding International Application No. PCT/CN2021/123060", Oct. 11, 2021, pp. 4, Published in: CN.

*Primary Examiner* — Glenn F Myers
(74) *Attorney, Agent, or Firm* — Neugeboren O'Dowd PC

(57) ABSTRACT

The present disclosure discloses a three-dimensional parking system, which mainly includes a supporting upright column, an annular railway, a parking platform, a platform bracket, a vertical power system, a rotating power system, and a platform interlocking system. A safety of a vehicle during transportation in a parking and picking up process can be improved by setting the platform interlocking system. Meanwhile, the three-dimensional parking system of the disclosure adopts a modular design, which facilitates assembly and transportation. The parking platform can be moved interactively by lifting and rotating, enabling that the vehicle can be parked and picked up quickly. The overall three-dimensional parking system has small floor area and high safety, so that urban space is used for parking efficiently and conveniently, thereby providing a subversive, multi-functional, and high-tech solution to the problem of parking difficult in cities at present.

19 Claims, 11 Drawing Sheets

(58) Field of Classification Search
USPC ..... 414/281, 282, 247, 249, 242, 263
See application file for complete search history.

(56) References Cited

FOREIGN PATENT DOCUMENTS

| | | | | |
|---|---|---|---|---|
| CN | 108999447 | A | | 12/2018 |
| CN | 110230421 | A | | 9/2019 |
| CN | 111877819 | A | | 11/2020 |
| JP | H05321499 | A | | 12/1993 |
| JP | 2003267677 | A | * | 9/2003 |

* cited by examiner

THREE-DIMENSIONAL PARKING SYSTEM

CROSS REFERENCE TO RELATED APPLICATION

This patent application is a national stage application of International Patent Application PCT/CN2021/123060 filed on Oct. 11, 2021, the disclosure of which is incorporated by reference herein in its entirety.

TECHNICAL FIELD

The present disclosure relates to the field of parking equipment, and in particular to a three-dimensional parking system.

BACKGROUND ART

At present, the number of motor vehicles in China has reached 372 million, and still maintains a growth trend. Correspondingly, a vacancy of parking places is also increasing. Traditional parking lots are mostly constructed on the ground or underground, utilization of ground parking space is low, an investment of underground parking garage is high, and there are risks of flood and waterlogging. Meanwhile, the existing parking lot not only has poor experience and low flexibility, but also takes up to 10 minutes to find a parking place and has low degree of intelligence, which greatly increases difficulty of car owners when parking. In view of this, in order to alleviate the issue of parking difficulty, three-dimensional parking equipment has been developed.

In China, the three-dimensional parking industry mainly includes three-dimensional parking buildings and independent three-dimensional parking equipment. The construction of the three-dimensional parking buildings occupies a large amount of urban land. In many cases, the utilization rate of these facilities is yet very low (about 20%-30%), which is mainly caused by a long distance and a slow process of entry and exit. An existing available solution on the market is a vertical cycle parking system. The existing vertical cycle parking system has been optimized to some extent in terms of space utilization rate, three-dimensional structure arrangement, intelligent parking operation, etc., but the turnover and transportation of vehicles will be involved in a process of parking or picking up because the three-dimensional parking equipment is mostly provided with multi-layer parking space in a height space, while the existing parking equipment pays no attention to safety issues in the process of turnover and transportation of vehicles, so the potential safety hazards of the vertical cycle parking system are increased.

SUMMARY

An object of the present disclosure is to provide a three-dimensional parking system. The parking system has reasonable structure arrangement and strong safety in use, and can effectively address the issue of great potential safety risks in the process of turnover and transportation of vehicles in the abovementioned existing parking equipment.

In order to achieve the abovementioned object, the present disclosure provides the following solutions:

The three-dimensional parking system provided according to the present disclosure mainly includes a supporting upright column, an annular railway, a parking platform, a platform bracket, a transportation module, a vertical power system, a rotating power system, and a platform interlocking system, wherein a longitudinal channel extending in an axial direction of the supporting upright column is arranged on the supporting upright column, the transportation module is arranged in the longitudinal channel, and the vertical power system is used for driving the transportation module to reciprocate up and down along the longitudinal channel;

the annular railway is arranged around a periphery of the supporting upright column, at least one layer of the annular railway is arranged in the axial direction of the supporting upright column, a notch is formed in a position of each layer of the annular railway penetrated by the longitudinal channel, and when the transportation module moves to the notch of any layer, the transportation module can form a closed circular ring railway with the annular railway of the current layer;

the platform bracket is movably arranged on the transportation module and each layer of the annular railway, and a parking platform is arranged on each of the platform brackets, the rotating power system is used for driving the platform bracket to move on the closed circular ring railway, so as to realize position displacement of the platform bracket between the transportation module and the annular railway of the current layer;

the platform interlocking system includes a pushing mechanism and a locking mechanism, each locking mechanism is arranged at a position of each layer of the annular railway close to the notch, and the locking mechanism on the annular railway where the transportation module does not stay is in a locked position, so as to lock the platform bracket on the annular railway of the current layer;

each platform brackets is configured with the pushing mechanism; and when the transportation module moves to the notch of any layer and forms the closed circular ring railway, the pushing mechanism drives the platform bracket on the transportation module to be in a force application position, so as to trigger the locking mechanism and enable the locking mechanism to unlock the platform bracket on the annular railway of the current layer.

Optionally, the three-dimensional parking system further includes a control system. The control system is in communication connection with at least one of the vertical power system, the rotating power system, and the platform interlocking system.

Optionally, each layer of the locking mechanism includes:

a locking rod, wherein a middle part of the locking rod is hinged to the annular railway, one end of the locking rod is provided with a boss which can prevent the platform bracket from moving along the annular railway, and the other end thereof is provided with an unlocking part which can be used for being pressed in a contact manner by the platform bracket on the transportation module; and a return spring, wherein the return spring is arranged between the locking rod and the annular railway, and can maintain a locking state of the boss to the platform bracket, and after the unlocking part is pressed in a contact manner by the platform bracket, the locking state is released.

Optionally, a bump or a clamping groove is formed in the abovementioned boss, so as to specifically carry out a locking behavior.

Optionally, each of the locking mechanisms is provided with a locking mechanism base. The middle part of the locking rod is hinged to the locking mechanism base. The return spring is arranged between the locking rod and the locking mechanism base. The locking mechanism base is fixedly mounted at a position on the annular railway close to the notch by bolts.

Optionally, any layer of the locking mechanism is provided with a state sensor. The state sensor is in communication connection with a control system of the three-dimensional parking system to monitor working state of the locking mechanism in real time.

Optionally, each layer of the annular railway includes an upper annular rail and a lower annular rail located below the upper annular rail. The notch is formed at each of the positions of the upper annular rail and the lower annular rail through which the longitudinal channel penetrates. Correspondingly, the transportation module includes an upper annular rail for a complementing notch and a lower support block, in which the upper annular rail for a complementing notch is used for butting with the upper annular rail of any layer to form an upper closed circular ring rail; a top of the platform bracket is hinged slidably to the upper annular rail for a complementing notch and the upper annular rail of any layer, that is, on the transportation module, the top of the platform bracket is hinged slidably to the upper annular rail for a complementing notch, and on the annular railway, the top of the platform bracket is hinged slidably to the upper annular rail;

the lower support block is used for butting with the lower annular rail of any layer to form a lower closed circular ring rail, and the upper closed circular ring rail and the lower closed circular ring rail form the closed circular ring railway together, so that the closed circular ring railway has a two-layer structure; and the lower support block is used for installing the pushing mechanism and/or the rotating power system. In actual operation, the locking mechanism base is fixedly mounted at a position on an upper surface of the lower annular rail close to the notch by bolts.

Optionally, on the transportation module, the top of each platform bracket is mounted slidably on the upper annular rail for a complementing notch through a slider, and the top of the platform bracket is hinged to the slider; and on the annular railway, the top of the platform bracket is mounted slidably on the annular rail through a slider, and the top of the platform bracket is hinged to the slider. Each slider is an annular slider. When the closed circular ring railway is formed, the annular sliders on all the platform brackets of the current layer are sequentially butted end to end to form a closed circular ring slider.

Optionally, a guide wheel block which can be fitted with the lower closed circular ring rail is arranged at a bottom or a middle part of each platform bracket.

Optionally, each set of the guide wheel blocks includes a side wheel, a longitudinal wheel, and a wheel bracket. Both the side wheel and the longitudinal wheel are mounted on the wheel bracket. The wheel bracket is fixed to the platform bracket, and is formed at least at the closed circular ring railway. When the rotating power system drives the platform bracket on the current layer to rotate, both the side wheel and the longitudinal wheel can be in rolling fit with the lower annular rail of the current layer. The side wheel is fitted with an upper surface of the lower annular rail. An axis of the side wheel is set perpendicular to the supporting upright column. The longitudinal wheel is fitted with an outer side surface of the lower annular rail. An axis of the longitudinal wheel is set parallel to the supporting upright column.

Optionally, the rotating power system includes:

annular ring gears, wherein the annular ring gears are fixedly mounted on the platform brackets, when the closed circular ring railway is formed, the annular ring gears on all the platform brackets of the current layer are sequentially butted end to end to form a closed circular ring gear;

a driving gear, wherein the driving gear is arranged on the lower support block or the lower annular rail, and is engaged with the closed circular ring gear, so as to drive the platform bracket to perform position displacement between the transportation module and the annular railway on the current layer; and a rotation driving mechanism, wherein the rotation driving mechanism is connected to the driving gear, so as to drive the driving gear to rotate.

Optionally, the pushing mechanism includes at least one pushing hydraulic cylinder. The pushing hydraulic cylinder includes a cylinder body and a cylinder rod. One of the cylinder body or the cylinder rod is connected to the annular ring gear, and the other thereof is connected to the bottom or the middle part of the platform bracket; and the pushing hydraulic cylinder (12) can push the platform bracket to rotate in a direction away from the supporting upright column around a hinged position of the top thereof.

Optionally, the cylinder body of the pushing hydraulic cylinder is fixed to the annular ring gear. One end of the cylinder rod is slidably connected to the cylinder body, and the other end thereof is connected to the bottom or the middle part of the platform bracket. The pushing hydraulic cylinder can push the platform bracket to rotate in the direction away from the supporting upright column around a hinged position of the top thereof. Specifically, the pushing mechanism is arranged on a corresponding annular ring gear, and both the platform bracket and the pushing mechanism matched therewith rotate with the corresponding annular ring gear.

Optionally, the pushing hydraulic cylinder is a piston hydraulic cylinder or a plunger hydraulic cylinder.

Optionally, the rotation driving mechanism is a driving electric motor or a driving motor.

Optionally, the longitudinal channel is provided with a lifting guide rail extending in an axial direction of longitudinal channel therein; and the transportation module is slidably connected to the lifting guide rail. Specifically, both the upper annular rail for complementing notch and the lower support block are slidably connected to the lifting guide rail. The lifting guide rail mainly plays a guiding role.

Optionally, the vertical power system includes a power driving mechanism and a power transmission chain. One end of the power transmission chain is connected to the power driving mechanism, and the other end thereof is connected to the transportation module.

Optionally, the power driving mechanism is a driving electric motor or a winch.

Optionally, a machine room for accommodating the power driving mechanism is arranged at the top of the supporting upright column.

Optionally, a bottom of the supporting upright column is fixedly mounted on the ground.

Optionally, the platform bracket is an L-shaped bracket which includes a vertical connecting rod and a horizontal supporting rod. A top of the vertical connecting rod is connected to the transportation module, and a bottom thereof is connected to one end of the horizontal supporting rod. The horizontal supporting rod is connected to the parking platform.

Optionally, the vertical connecting rod and the horizontal supporting rod are integrally formed.

Optionally, the parking platform includes:

a platform body;

an entrance-exit ramp, wherein the entrance-exit ramp is arranged on an upper surface of the platform body, and the entrance-exit ramp extends in a length direction of the platform body and is used for guiding a vehicle to enter and exit the platform body;

a start passage, wherein the start passage is arranged at one end of the upper surface of the platform body, a front wheel pressure plate is arranged in the start passage, and the front wheel pressure plate is connected to an interior of the start passage through a spring, that is, the front wheel pressure plate is preloaded by the spring; and when a front wheel of the vehicle travels to the front wheel pressure plate, the front wheel pressure plate is started, and a signal is transmitted to the control system of the three-dimensional parking system.

Optionally, the three-dimensional parking system further includes safety light curtains arranged on the supporting upright column. Two safety light curtains are provided. When the transportation module is located on the ground and there is a vehicle to be parked which is driven into transportation module thereon, the two light curtains respectively illuminate a front end edge and a rear end edge of the parking platform, so as to prevent a vehicle head or a vehicle tail from extending beyond the parking platform. The safety light curtains are in communication connection with the control system.

Optionally, the safety light curtains are laser sensors. The laser sensors are in communication connection with the control system.

Optionally, the three-dimensional parking system further includes a vehicle height detection sensor arranged on the supporting upright column. The vehicle height detection sensor is in communication connection with the control system. The vehicle height detection sensor may be a laser sensor.

Optionally the three-dimensional parking system further includes a bottom sensor arranged at a bottom of the parking platform. The bottom sensor is used as a safety device for detecting whether there is an obstacle in a landing area of the parking platform when the parking platform lands to the ground. The bottom sensor is in communication connection with the control system of the three-dimensional parking system.

Optionally, the three-dimensional parking system further includes a safety protective cover. The safety protective cover is arranged on a periphery of the three-dimensional parking system.

Optionally, a bottom layer parking area monitoring device is arranged on the supporting upright column, and is used for monitoring entry and exit of the parking area. The bottom layer parking area monitoring device is in communication connection with the control system.

Optionally, at least one of a solar charging device, a lighting device, and a billboard is also arranged on the supporting upright column. In case that the lighting device is arranged at the top of the supporting upright column, the overall three-dimensional parking system is shaped like a "street lamp", showing one object has a variety of purposes.

Optionally, the three-dimensional parking system further includes a client APP. The client APP is in communication connection with the control system, which can realize reserving a parking place, controlling parking and pick-up processes, paying fees, and the like through existing program settings.

The present disclosure achieves the following technical effects over the prior art:

The three-dimensional parking system provided according to the present disclosure has reasonable structural arrangement. The platform interlocking system is arranged, and a pushing mechanism thereof can ensure that the platform bracket is kept in an inclined state during lifting, so as to ensure that there is a gap required for the vertical movement of the transportation module reserved between the platform bracket and the longitudinal channel, and meanwhile, a vehicle on a platform is prevented from falling off in a lifting process. Linkage between the pushing mechanism and the locking mechanism can be realized. The pushing mechanism pushes the platform bracket to move in the direction far away from the supporting upright column, which ensures smooth running of the transportation module in the longitudinal channel, so that the platform bracket is released from contact with the locking mechanism, and the locking mechanism locks the other platform brackets on the annular rail to prevent the platform brackets remained on the annular rail from moving freely. When the transportation module carries the platform bracket to stay at the notch of a certain layer, the pushing mechanism drives the platform bracket to move in the direction close to the supporting upright column to close the gap required for the vertical movement of the transportation module, and meanwhile, the locking mechanism is pressed to generate displacement, so as to unlock the platform bracket on the annular railway on the current layer to actuate a rotating function, thereby realizing the position displacement of the platform bracket between the transportation module and the annular railway of the current layer. The safety of a vehicle during transportation in a parking and picking up process is effectively improved.

It can be seen from the above that the three-dimensional parking system of the present disclosure adopts a modular design, which facilitates assembly and transportation. The parking platforms can move interactively by lifting and rotating, enabling vehicles to be parked and picked up quickly. The overall three-dimensional parking system occupies a small area, has high safety, utilizes urban space for parking efficiently and conveniently, and thus provides a suitable, multi-functional, and high-tech solution to the challenging urban parking.

BRIEF DESCRIPTION OF THE DRAWINGS

To illustrate technical solutions in embodiments of the present disclosure or in the prior art more clearly, the drawings required for showing the embodiments are described briefly hereinafter. The drawings in the following description merely show some embodiments of the present disclosure, and those of ordinary skill in the art may still derive other drawings from these drawings without undue experimentation.

Figure 1:
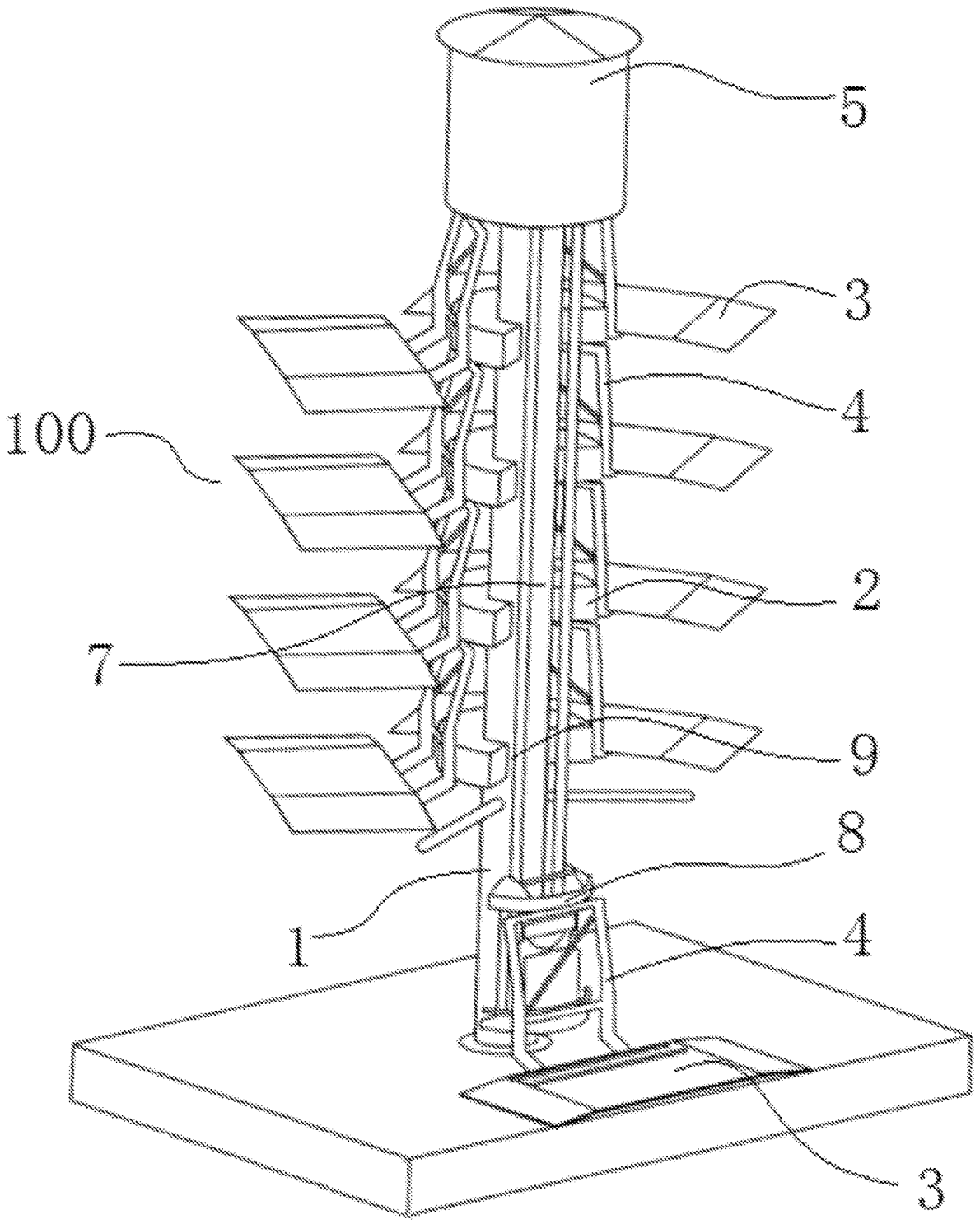
FIG. 1 is a schematic diagram of an overall structure of a three-dimensional parking system disclosed by the embodiments of the present disclosure.

Reference numerals in the drawings are as follows:

100, three-dimensional parking system;

1, supporting upright column; 2, annular railway; 21, lower annular rail; 3, parking platform; 31, entrance-exit ramp; 32, start passage; 33, front wheel pressure plate; 4, platform bracket; 5, vertical power system; 51, power driving mechanism; 52, power transmission chain; 6, rotating power system; 61, annular ring gear; 62, driving gear; 63, rotation driving mechanism; 7, longitudinal channel; 8 transportation module; 81, lower support block; 82, upper annular rail for complementing notch; 9, notch; 10, locking mechanism; 11, guide wheel block; and 12, pushing hydraulic cylinder.

DETAILED DESCRIPTION OF THE EMBODIMENTS

Technical solutions in embodiments of the present disclosure will be clearly and completely described below with reference to the drawings showing the embodiments of the present disclosure. The described embodiments are merely part rather than all of the embodiments of the present disclosure. On the basis of the embodiments of the present disclosure, all other embodiments obtained by those of ordinary skill in the art without undue experimentation fall within the scope of the present disclosure.

One of the objectives of the present disclosure is to provide a three-dimensional parking system, which has reasonable structure arrangement and strong safety in use, and can effectively address the issue of potential safety hazards in the process of turnover and transportation of vehicles in existing parking equipment.

In order to make the abovementioned objective, features, and advantages of the present disclosure more apparent and comprehensible, the present disclosure is further described in detail below with reference to the drawings and the embodiments.

Embodiment 1

As shown in FIG. 1 to FIG. 11, the present embodiment provides a three-dimensional parking system 100, which mainly includes a supporting upright column 1, an annular railway 2, a parking platform 3, a platform bracket 4, a transportation module 8, a vertical power system 5, a rotating power system 6, and a platform interlocking system. A longitudinal channel 7 extending in an axial direction of the supporting upright column 1 is arranged on the supporting upright column 1. The transportation module 8 is arranged in the longitudinal channel 7. The vertical power system 5 is used for driving the transportation module 8 to reciprocate up and down along the longitudinal channel 7. The annular railway 2 is arranged around a periphery of the supporting upright column 1. At least one layer of the annular railway 2 is arranged in the axial direction of the supporting upright column 1 in a spaced manner. A notch 9 is formed in a position of each layer of annular railway 2 penetrated by the longitudinal channel 7. When the transportation module 8 moves to the notch 9 of any layer, the transportation module 8 can form a closed circular ring railway with the annular railway 2 of the current or correspondingly layer. The platform bracket 4 is movably arranged on the transportation module 8 and each layer of the annular railway 2. Each of the platform brackets 4 is provided with a parking platform 3 for loading a vehicle to be parked thereon. The rotating power system 6 is used for driving the corresponding platform bracket 4 to move on the closed circular ring railway formed above, so as to realize position displacement of the platform bracket 4 between the transportation module 8 and the annular railway 2 of the current layer, thereby implementing parking or picking up of the vehicle. The platform interlocking system includes a pushing mechanism and a locking mechanism 10. Each locking mechanism 10 is arranged at a position of each layer of annular railway 2 close to the notch. The locking mechanism 10 on the annular railway 2 where the transportation module 8 does not stay (that is, the notch of the annular railway 2 is in an open state) is in a locked position, so as to lock the platform bracket 4 on the annular railway 2 of the current layer, thereby preventing the platform bracket 4 from moving freely on the annular railway 2 of the current layer. Each platform bracket 4 is configured with the pushing mechanism. When the transportation module 8 moves to the notch 9 of any layer and forms the closed circular ring railway (that is, the notch of the annular railway 2 is closed by the transportation module 8), the pushing mechanism drives the platform bracket 4 on the transportation module 8 to be in a force application position, so as to trigger the locking mechanism 10 and enable the locking mechanism 10 to unlock the platform bracket 4 on the annular railway 2 of the current layer, thereby realizing the position displacement of the platform bracket 4 between the transportation module 8 and the annular railway 2 of the current layer.

In the present embodiment, the three-dimensional parking system further includes a control system. The control system is in communication connection with at least one of the vertical power system 5, the rotating power system 6, and the platform interlocking system mentioned above. As a preference, the control system is in communication connection with each of the vertical power system 5, the rotating power system 6, and the platform interlocking system mentioned above, in order to control the operation of the overall three-dimensional parking system 100.

In the present embodiment, each layer of the locking mechanism 10 includes a locking rod and a return spring. A middle part of the locking rod is hinged to the annular railway 2. One end of the locking rod is provided with a boss which can prevent the platform bracket 4 from moving along the annular railway 2, and the other end thereof is provided with an unlocking part which can be used for being pressed in a contact manner by the platform bracket 4 on the transportation module 8. The return spring is arranged between the locking rod and the annular railway 2, and can maintain a locking state of the boss to the platform bracket 4. And after the unlocking part is pressed in a contact manner by the platform bracket 4, the locking state is released (that is, after the locking rod overcomes an elastic force of the spring, the boss is moved to an unlocked position where the platform bracket is not prevented from moving along the annular railway). As a preference, the abovementioned boss is provided with a bump or a clamping groove, so as to specifically implement a locking behavior. For example, the bump or the clamping groove is snap-fitted into the rotating power system 6 of the current layer to prevent normal operation of the rotating power system 6 of the current layer, so as to achieve locking the platform bracket 4 on the annular railway 2 of the current layer, and thereby prevent the platform bracket 4 from moving or offsetting on the annular railway 2, which is beneficial to reducing the risk of the vehicle falling and improving the safety of the vehicle staying in the air.

In the present embodiment, the locking mechanisms 10 each are provided with a locking mechanism base. The middle part of the locking rod is hinged to the locking mechanism base. The return spring is arranged between the locking rod and the locking mechanism base. The locking mechanism base is fixedly mounted at a position of the annular railway 2 close to the notch by bolts, so that the locking mechanism 10 can be triggered in time when the transportation module 8 complements the notch of the current layer, thereby releasing the limitation to the rotation of the platform bracket 4 on the current layer.

In the present embodiment, each layer of the locking mechanism 10 of is provided with a state sensor. The state sensor is in communication connection with the control system of the three-dimensional parking system 100 to monitor working state of the locking mechanism 10 in real time, that is, to monitor whether the locking mechanism 10 is in a locked state or an unlocked state, and to transmit real-time state information to the control system.

In the present embodiment, each layer of the annular railway 2 includes an upper annular rail and a lower annular rail 21 located below the upper annular rail. The notch 9 is formed at each of the positions of the upper annular rail and the lower annular rail 21 through which the longitudinal channel 7 penetrates. Correspondingly, the transportation module 8 includes an upper annular rail for complementing notch 82 and a lower support block 81. The upper annular rail for complementing notch 82 is used for butting with upper annular rail of any layer to form an upper closed circular ring rail. A top of the platform bracket 4 is hinged slidably to the upper annular rail for complementing notch 82 and the upper annular rail of any layer. The lower support block 81 is used for butting with lower annular rail 21 of any layer to form a lower closed circular ring rail. The upper closed circular ring rail and the lower closed circular ring rail form a closed circular ring railway together. In this way, each set of closed circular ring railway has a double-layer structure. In the present embodiment, the lower support block 81 can be used for installing the pushing mechanism and/or the rotating power system 6. In an actual operation, the locking mechanism base is fixedly mounted at a position on an upper surface of the lower annular rail 21 close to the notch by bolts.

In the present embodiment, as a preference, in order to save axial space of the supporting upright column 1, any two adjacent annular railways 2 share a common annular rail structure. For example, the upper annular rail of the lowest annular railway 2 and the lower annular rail of the penultimate layer of annular railway 2 are combined into one, and the upper part can serve as a lower annular rail of an upper layer, and the lower part can serve as an upper annular rail of a lower layer. In an actual operation, in order to avoid the overall stability imbalance caused by the parking system being too high, it is preferred to arrange four layers (sets) of annular railways 2 uniformly spaced in the axial direction of the supporting upright column 1. Meanwhile, two to four platform brackets 4 are simultaneously fitted on the annular railway 2 where the transportation module 8 does not stay. The transportation module 8 is provided with a platform bracket 4 all the time. On the closed circular railway, three to five platform brackets 4 can be realized to operate simultaneously. As a preference, in the present embodiment, two platform brackets 4 are simultaneously fitted on the annular railway 2 where the transportation module 8 does not stay. The transportation module 8 is provided with a platform bracket 4 all the time. And three platform brackets 4 can be realized to operate simultaneously on the formed closed circular ring railway of each layer.

More specifically, on the basis of the structure that three platform brackets 4 can be realized to operate simultaneously on the closed circular ring railway, each of the upper annular rail and the lower annular rail 21 is set as a ⅔ circular ring structure (corresponding to a central angle of 240°), and the upper annular rail for complementing notch 82 and the lower support block 81 are respectively ⅓ circular ring structures (corresponding to a central angle of 120°). Four layers of annular railways 2 are adopted, each layer of annular railway 2 is provided with two platform brackets 4 and the transportation module 8 is always provided with a platform bracket 4, such that there are nine parking places in the system in total, thereby realizing efficient utilization of space.

In the present embodiment, taking an installation structure of the platform brackets 4 on the upper annular rail for complementing notch 82 as an example, the foregoing "hinged slidably" refers to that the top of the platform bracket 4 can slide along the upper annular rail for complementing notch 82, and can also rotate relative to the upper annular rail for complementing notch 82. In an actual operation, the following way can be adopted. The top of any platform bracket 4 can be mounted slidably on the upper annular rail for complementing notch 82 or a corresponding layer of upper annular rail through a slider. The top of the platform bracket 4 is hinged to the slider through a hinge or a pin shaft. Each slider is an annular slider. When the closed circular ring railway is formed, the annular sliders on all the platform brackets 4 of the current layer are sequentially butted end to end to form a closed circular ring slider. As a preference of the present embodiment, each annular slider is set as a ⅓ annular structure (corresponding to a central angle of 120°). Of course, in case that more than three platform brackets 4 are arranged on the closed circular ring railway, the corresponding center angles of the annular sliders, the upper annular rails, the lower annular rails 21, the upper annular rail for complementing notch 82, and lower support blocks 81 can be adjusted adaptively.

In the present embodiment, a guide wheel block 11 which can be fitted with the lower closed circular ring rail is arranged at a bottom or a middle part of each platform bracket 4. The guide wheel block 11 includes a guide wheel. As a preference, each set of the guide wheel blocks 11 includes a side wheel, a longitudinal wheel, and a wheel bracket. Both the side wheel and the longitudinal wheel are mounted on the wheel bracket. The wheel bracket is fixed to the platform bracket 4, and is formed at least at the closed circular ring railway. When the rotating power system 6 drives the platform bracket 4 on the current layer to rotate, both the side wheel and the longitudinal wheel can be in sliding fit with the lower annular rail 21 of the current layer. The longitudinal wheel is fitted with an upper surface of the lower annular rail 21, and an axis of the longitudinal wheel is set perpendicular to the supporting upright column 1. The side wheel is fitted with an outer side surface of the lower annular rail 21, and an axis of the side wheel is set parallel to the supporting upright column 1. Two sets of the abovementioned guide wheel blocks 11 are preferably arranged on any platform bracket 4.

Figure 3:
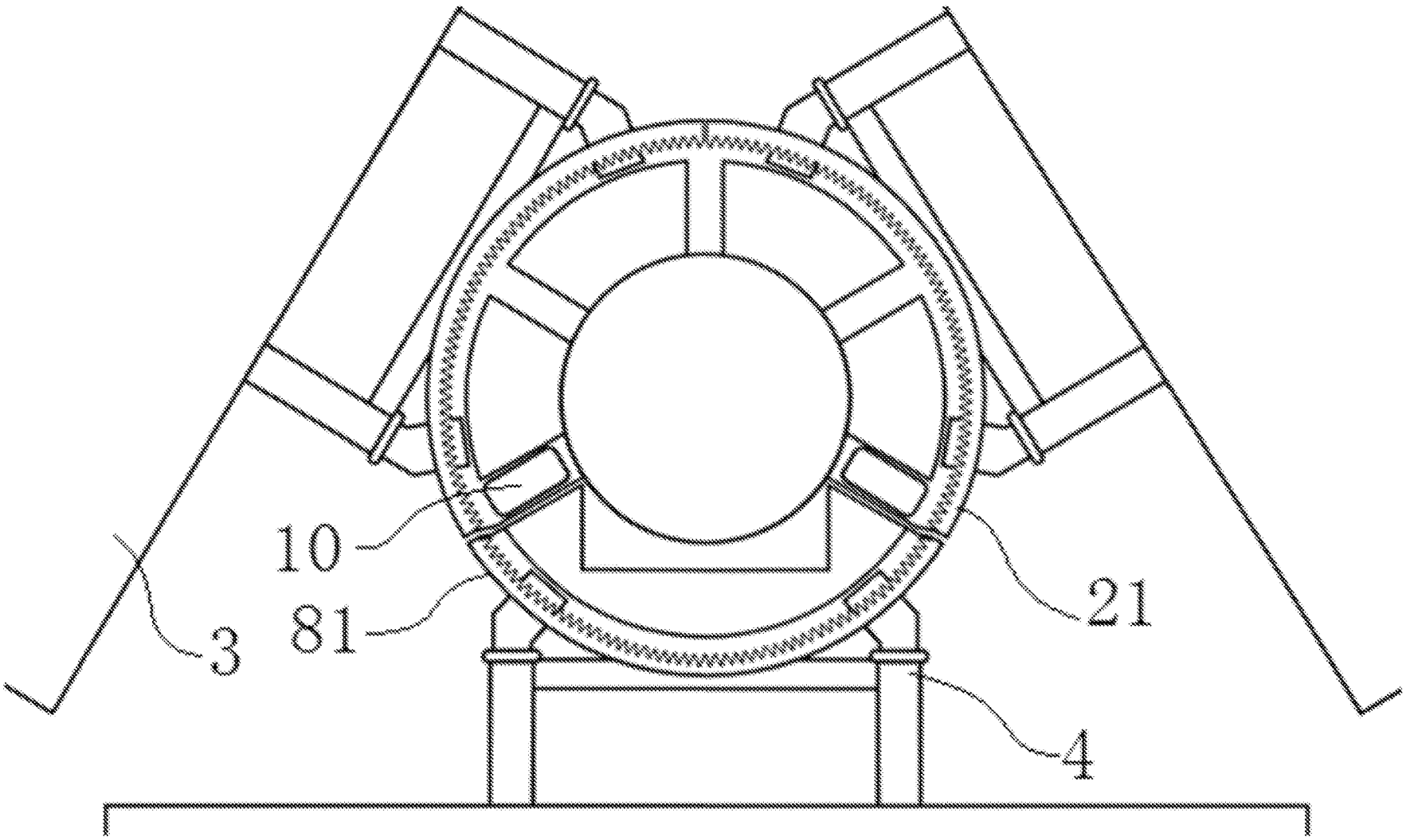
FIG. 3 is a schematic diagram of an overall structure of a rotating power system in the three-dimensional parking system disclosed by the embodiments of the present disclosure.
Figure 4:
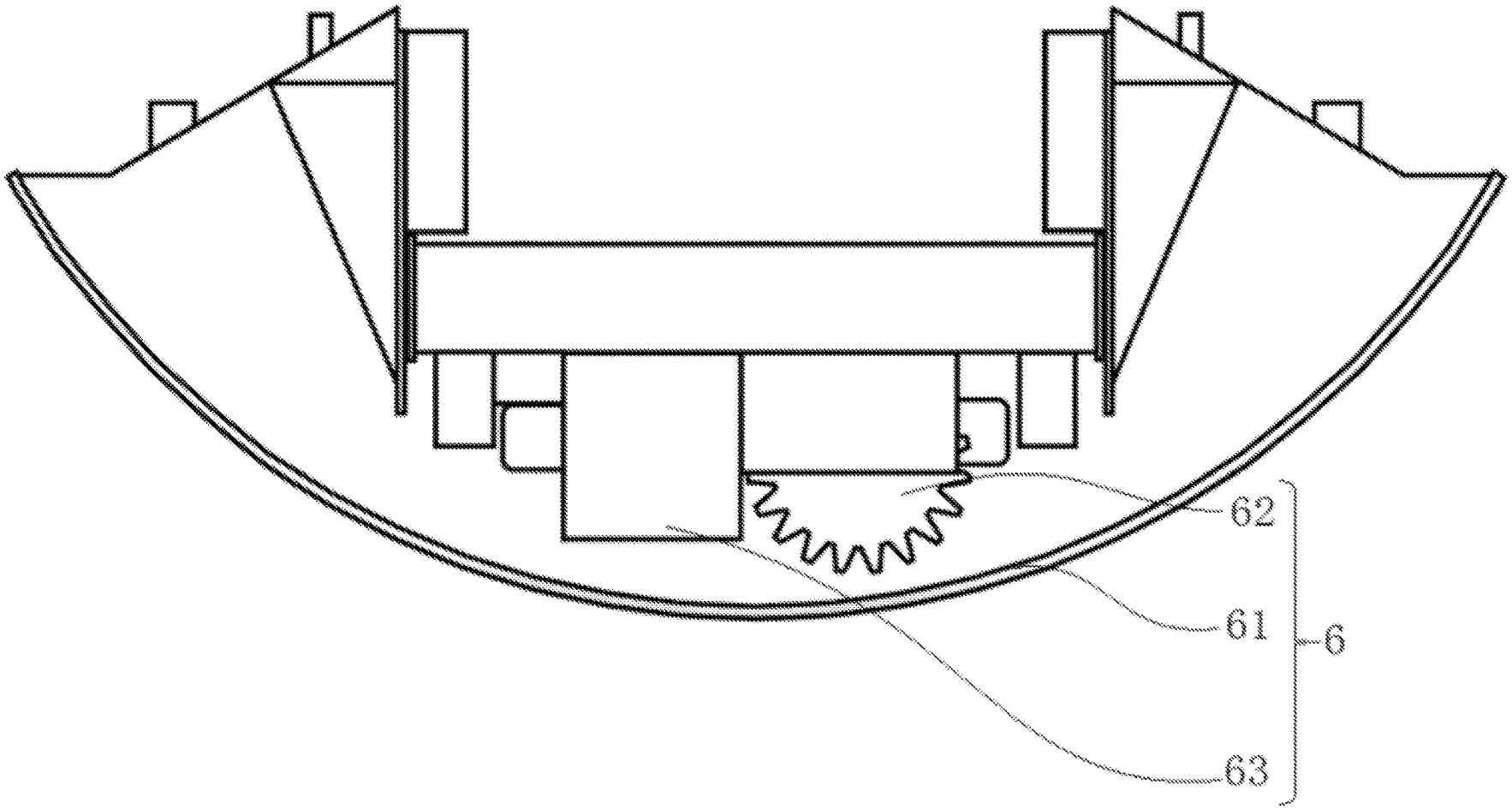
FIG. 4 is a schematic diagram of a local structure of the rotating power system in the three-dimensional parking system disclosed by the embodiments of the present disclosure.
Figure 5:
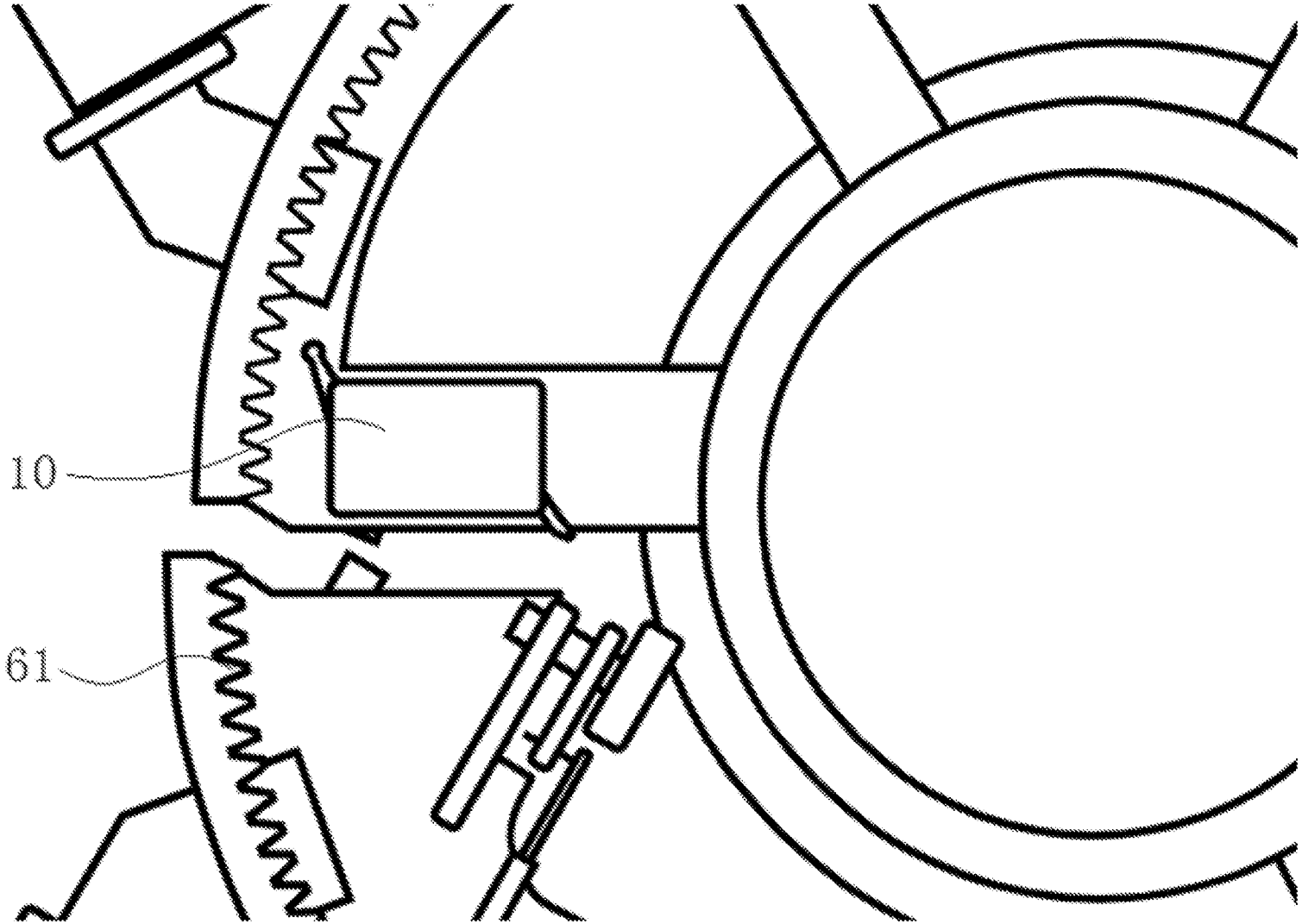
FIG. 5 is a principle diagram showing formation of a closed annular ring gear in the three-dimensional parking system disclosed by the embodiments of the present disclosure.
Figure 6:
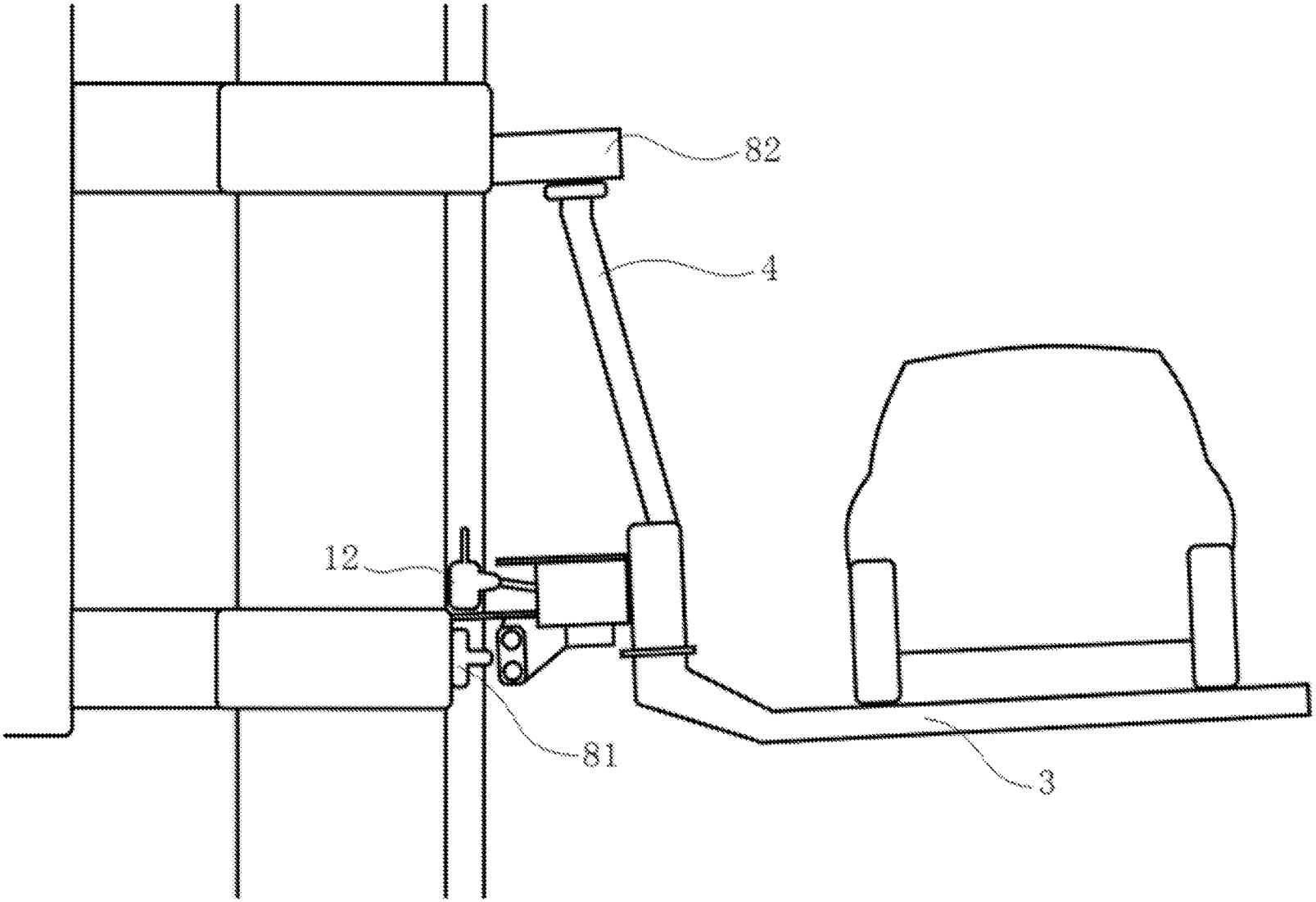
FIG. 6 is a schematic diagram of a vehicle loading state of a platform bracket in the three-dimensional parking system disclosed by the embodiments of the present disclosure.
Figure 7:
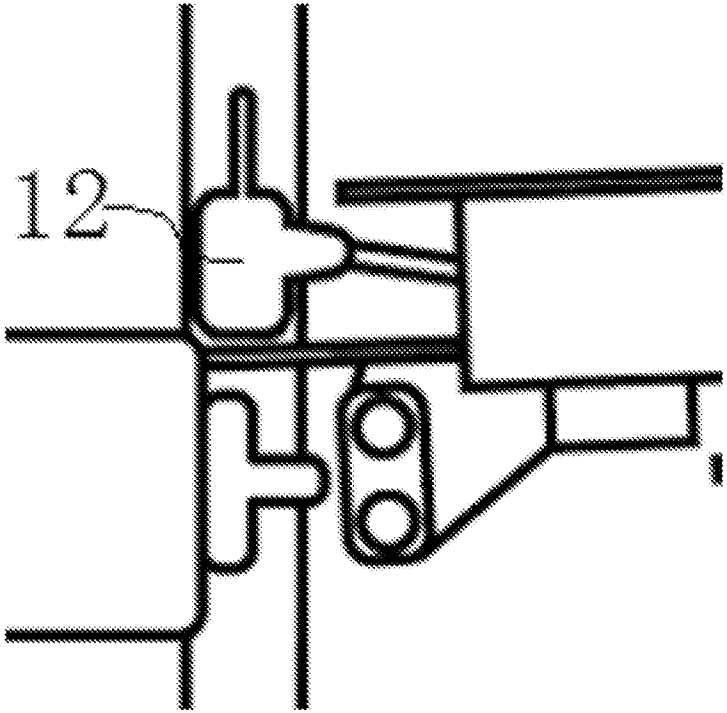
FIG. 7 is a schematic diagram of a pushing mechanism in the three-dimensional parking system disclosed by the embodiments of the present disclosure.
Figure 8:
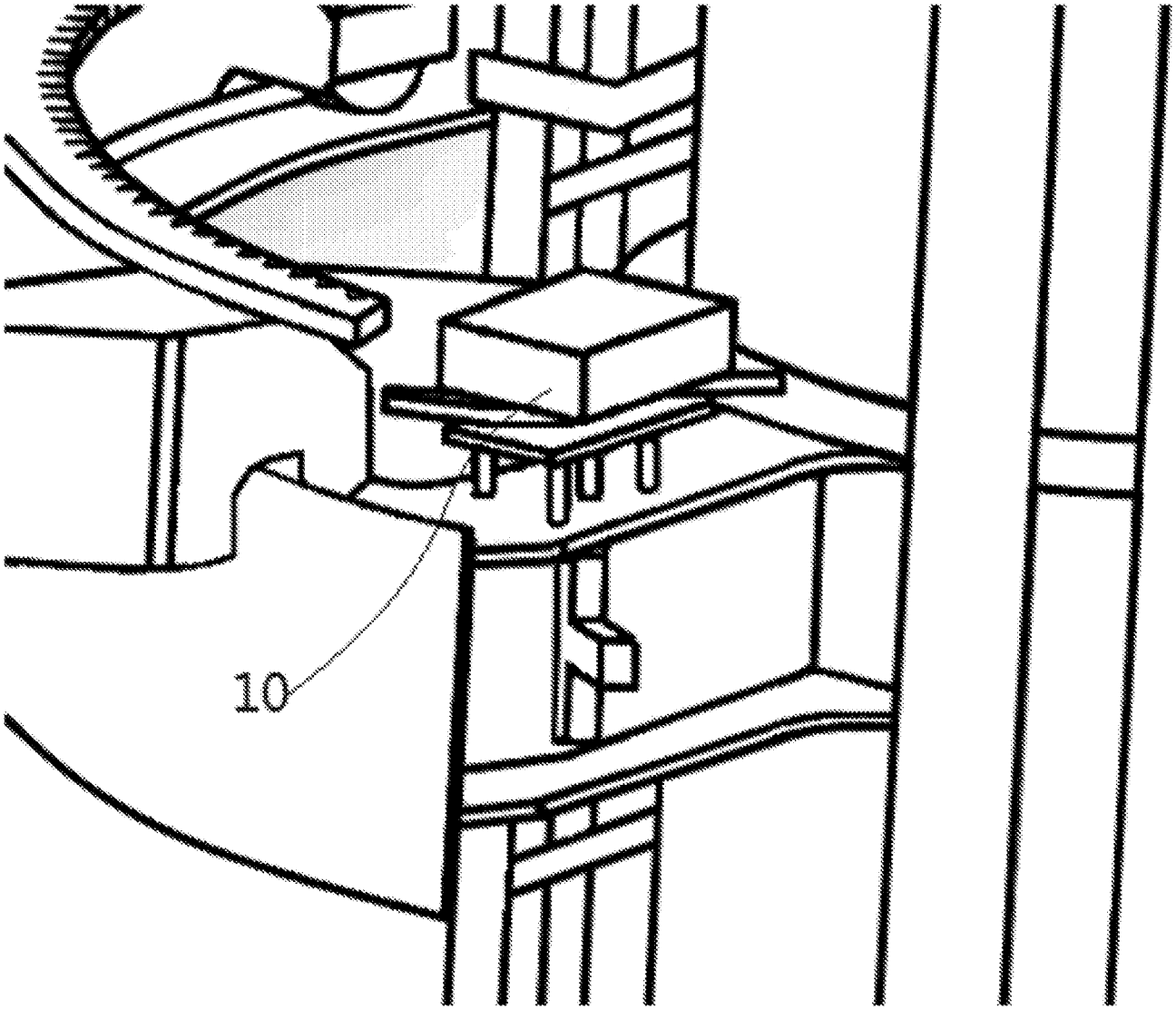
FIG. 8 is a schematic diagram of a locking mechanism in the three-dimensional parking system disclosed by the embodiments of the present disclosure.
Figure 9:
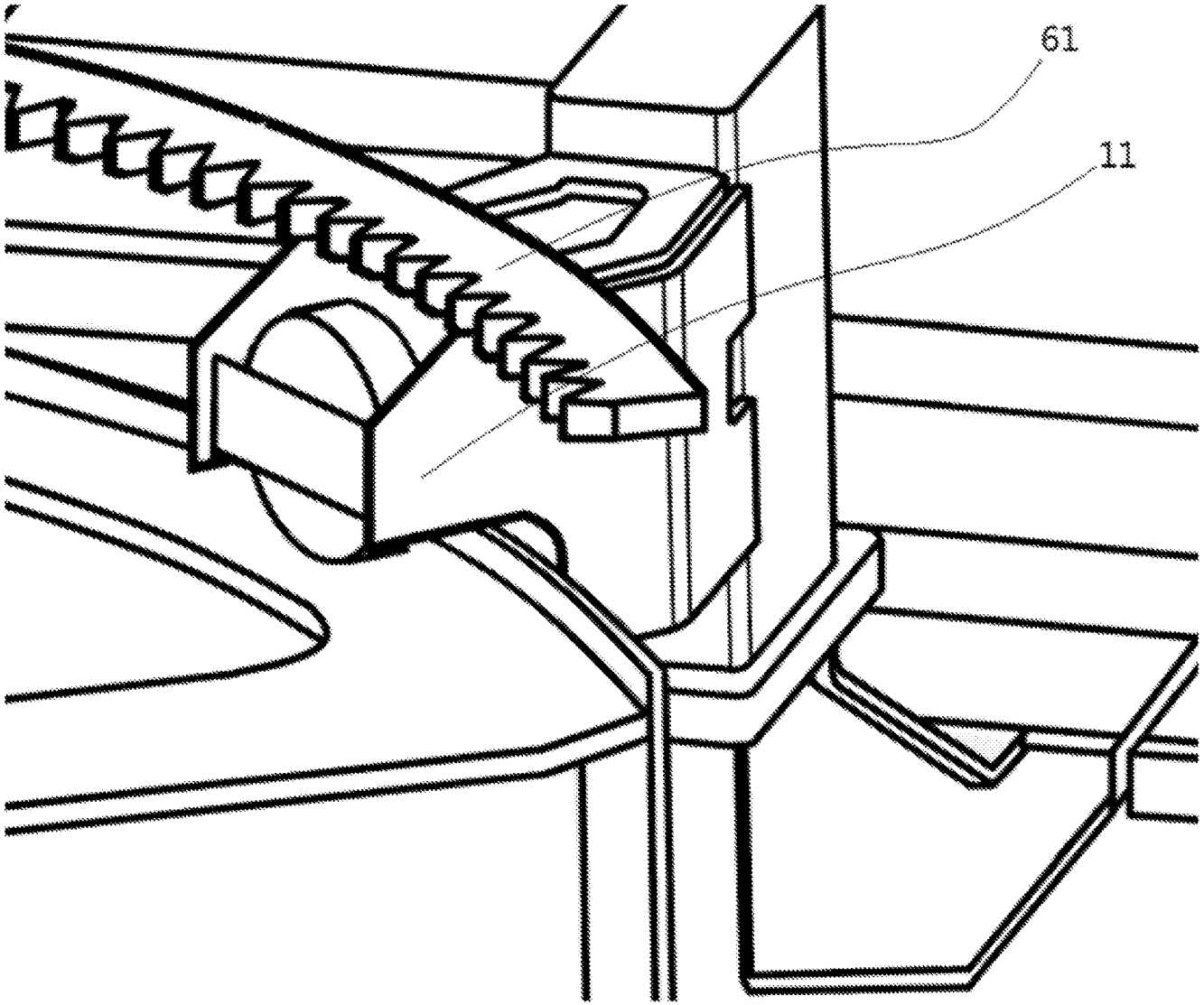
FIG. 9 is a schematic diagram of a guide wheel block in the three-dimensional parking system disclosed by the embodiments of the present disclosure.

In the present embodiment, as shown in FIG. 3 to FIG. 5, the rotating power system 6 includes annular ring gears 61, a driving gear 62, and a rotation driving mechanism 63. The annular ring gears 61 are fixedly mounted on the platform bracket 4. When the closed circular ring railway is formed, the annular ring gears 61 on all the platform brackets 4 of the current layer are sequentially butted end to end to form a closed circular ring gear. The driving gear 62 is arranged on the lower support block 81 or the lower annular rail 21 and is engaged with the closed circular ring gear, so as to drive the platform bracket 4 to perform the position displacement between the transportation module 8 and the annular railway 2 on the current layer. The rotation driving mechanism 63 is connected to the driving gear 62, so as to drive the driving gear 62 to rotate. The rotation driving mechanism 63 may be a driving electric motor, a driving motor, a mechanical transmission mechanism including a gear transmission mechanism, or the like. The rotation driving mechanism 63 can be fixed to the lower annular rail 21 or the lower support block 81 of the transportation module 8, and itself should have a locking or locking-up structure to further improve the locking effect of the rotating power system 6 on the platform bracket 4 during lifting and lowering of the transportation module 8. For example, when the rotation driving mechanism 63 adopts a driving motor, a motor shaft locking device may be arranged in the motor to realize such a locking function.

In the present embodiment, it is preferred that the driving gear 62 is located at an inner ring of the annular ring gear 61, so as to form an internal engagement gear assembly therebetween. In an actual operation, an external engagement form can also be adopted between the driving gear 62 and the annular ring gear 61, that is, the driving gear 62 is located on outside of the annular ring gear 61. In this case, one driving gear 62 can be provided, or one driving gear 62 can be arranged on each platform bracket 4. A specific arrangement form of the rotating power system 6 cannot be limited to the abovementioned forms of internal and external gear engagement, but can also be a gear engagement set containing multiple gears or other structures including a worm and worm wheel driving form, depending on an actual situation.

In the present embodiment, the pushing mechanism includes at least one pushing hydraulic cylinder 12. The pushing hydraulic cylinder 12 includes a cylinder body and a cylinder rod. One of the cylinder body or the cylinder rod is connected to annular ring gear 61, and the other is connected to the bottom or the middle part of the platform bracket 4. For example, in the present embodiment, the cylinder body is hinged to the annular ring gear 61, and the cylinder rod is hinged to the bottom of the platform bracket 4, and the pushing hydraulic cylinder 12 can push the platform bracket 4 to rotate in a direction away from the supporting upright column 1 around a hinged position at the top thereof. Specifically, the pushing mechanism is arranged on a corresponding annular ring gear 61, and both the platform bracket 4 and the pushing mechanism matched therewith rotate with the corresponding annular ring gear 61. The pushing hydraulic cylinder 12 can be a piston hydraulic cylinder or a plunger hydraulic cylinder. The pushing mechanism can drive the platform bracket 4 to tilt radially outward for starting during the lifting of the platform bracket 4. The pushing mechanism drives the platform bracket 4 to tilt radially outward, so that an outer side of the parking platform 3 can be elevated upwards, and a vehicle on the parking platform 3 gets close to the platform bracket 4, which can prevent the vehicle from falling off from the platform bracket 4 during the lifting of the platform bracket 4, and is beneficial to improve the safety performance of the parking system during lifting. During the lifting of the transportation module 8, the pushing mechanism pushes the platform bracket 4 to move in the direction far away from the supporting upright column, ensuring that the transportation module 8 smoothly runs in the longitudinal channel 7, and the platform bracket 4 is released from contact with the locking mechanism 10, in which the locking mechanism 10 locks the remaining platform brackets on the annular railway to prevent the remaining platform brackets on the annular railway from moving freely. When the transportation module 8 carries the platform bracket 4 to stay at the notch of a certain layer, the pushing mechanism brings the platform bracket to move towards the direction close to the supporting upright column, so as to close the gap required for the vertical movement of the transportation module, and meanwhile, the locking mechanism is pressed and displaced, so as to unlock the platform bracket on the annular railway on the current layer and start a rotating function, thereby realizing the position displacement of the platform bracket between the transportation module and the annular railway of the current layer. It can be seen from the above that the pushing mechanism can also have a linkage effect with the locking mechanism 10. As mentioned above, in the present embodiment, the locking mechanism 10 can be further triggered to enable the locking mechanism 10 to release the locking effect on the platform bracket 4 only when a tilt function is off.

In the present embodiment, the longitudinal channel 7 is provided with a lifting guide rail (not shown in the figures) extending in an axial direction of the longitudinal channel 7 therein. The transportation module 8 is slidably connected to the lifting guide rail. Specifically, both the upper annular rail for complementing notch 82 and the lower support block 81 are slidably connected to the lifting guide rail. The lifting guide rail mainly plays a guiding role.

Figure 2:
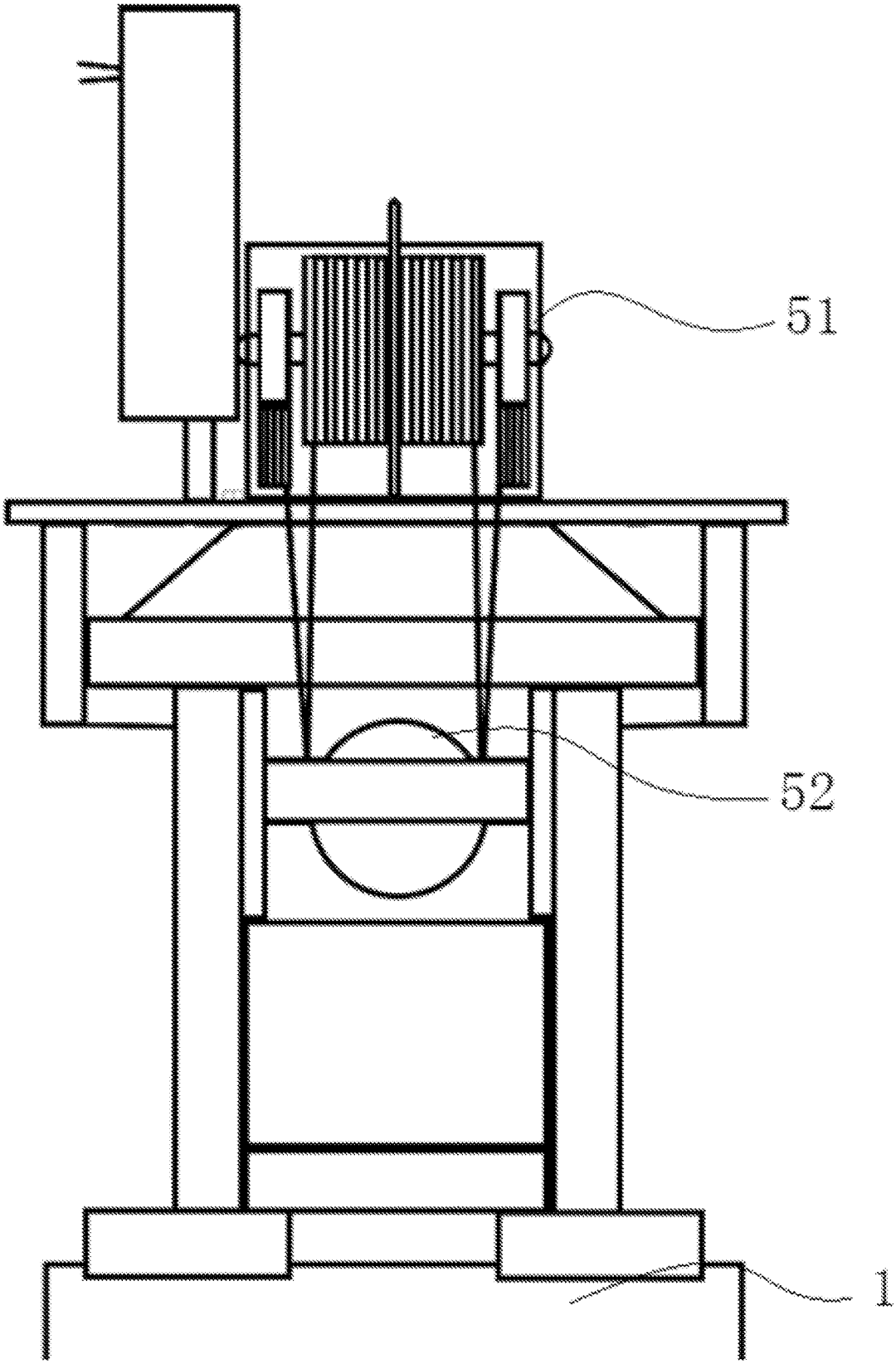
FIG. 2 is a schematic structural diagram of a vertical power system in the three-dimensional parking system disclosed by the embodiments of the present disclosure.

In the present embodiment, as shown in FIG. 1 and FIG. 2, the vertical power system 5 includes a power driving mechanism 51 and a power transmission chain 52. One end of the power transmission chain 52 is connected to the power driving mechanism 51, and the other end thereof is connected to the transportation module 8. The power driving mechanism 51 is a lifting electric motor or a winch, and a machine room for accommodating the power driving mechanism 51 is arranged at the top of the supporting upright column 1. The power transmission chain 52 may be a movable pulley assembly, or a mechanical transmission mechanism including a gear engagement transmission assembly, a gear-rack engagement transmission assembly, etc. When the power transmission chain 52 adopts the movable pulley assembly, it is similar to an elevator driving system, which will not be described herein.

Further, the power driving mechanism 51 can preferably adopt a cable winch. A pedestrian passage and a control cabinet matched with a winch assembly are arranged in the machine room. The vertical power system 5 and the machine room can be transported to the top of the supporting upright column after pre-assembly on the ground. The cable winch is provided with a capstan, a gear driving mechanism used for driving the capstan, a brake, etc.

In the present embodiment, the bottom of the supporting upright column 1 is fixedly mounted on the ground. In the present embodiment, the platform bracket 4 is an L-shaped bracket, which includes a vertical connecting rod and a horizontal supporting rod. A top of the vertical connecting rod is connected to the transportation module 8, and a bottom thereof is connected to one end of the horizontal supporting rod. The horizontal supporting rod is connected to the parking platform 3. As a preference, the vertical connecting rod and the horizontal supporting rod are integrally formed.

Figure 10:
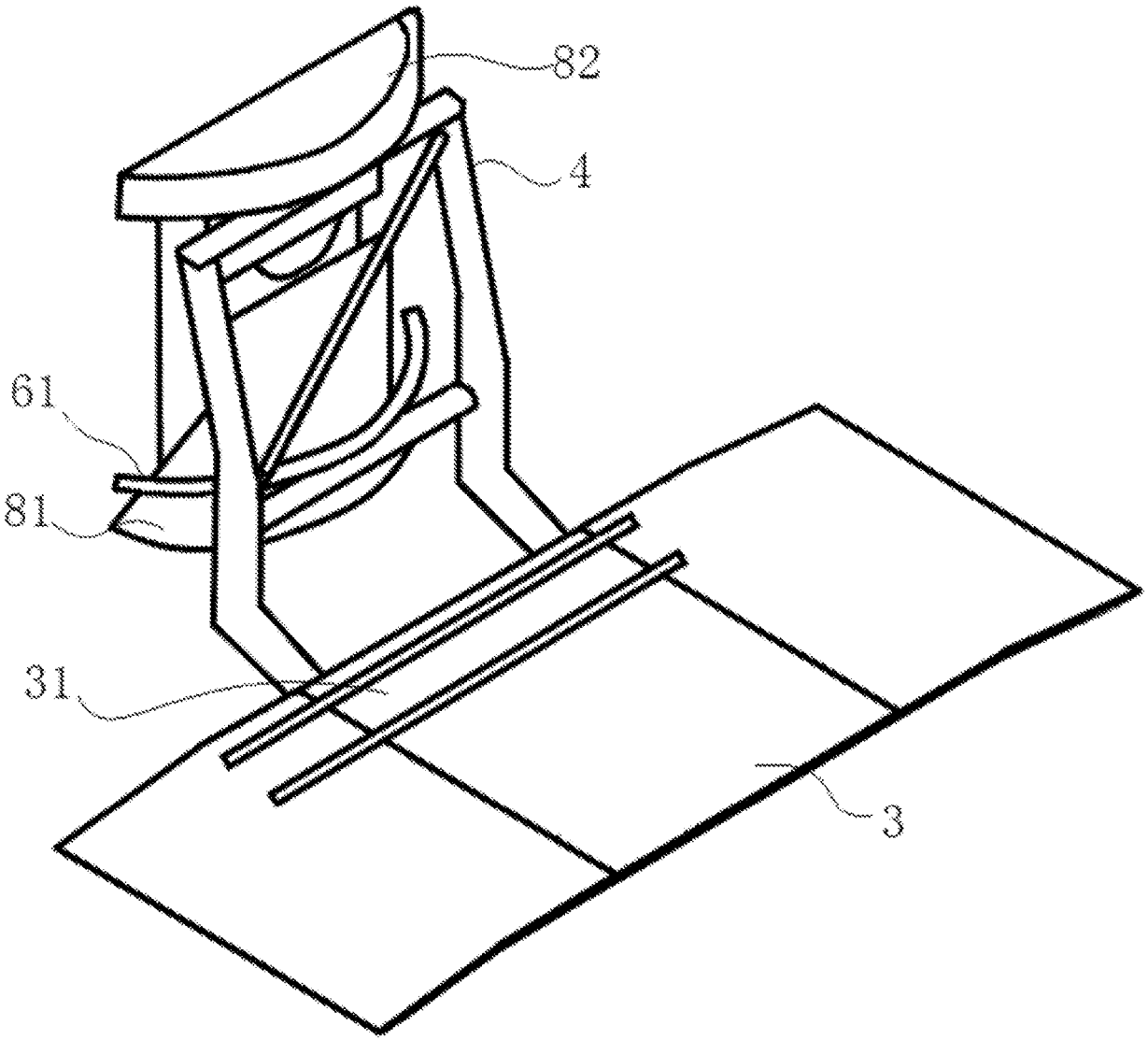
FIG. 10 is a schematic diagram of a parking platform in three-dimensional parking system disclosed by the embodiments of the present disclosure.
Figure 11:
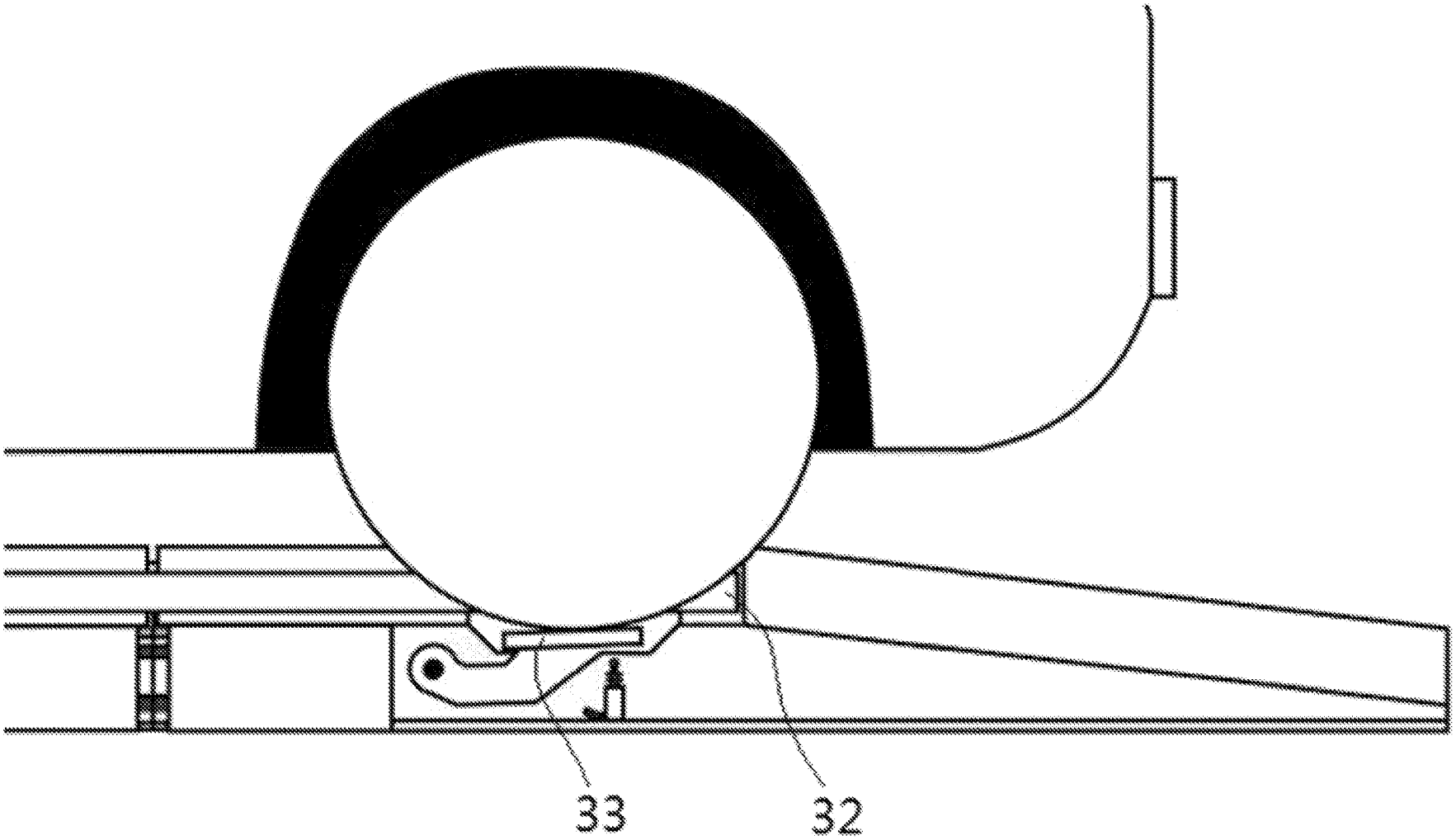
FIG. 11 is a schematic diagram of a front wheel pressure plate in the three-dimensional parking system disclosed by the embodiments of the present disclosure.

In the present embodiment, as shown in FIG. 10 to FIG. 11, the parking platform 3 includes a platform body. An entrance-exit ramp 31 is arranged on an upper surface of the platform body, and the entrance-exit ramp 31 extends in a length direction of the platform body and is used for guiding a vehicle to enter and exit the platform body. In order to fix a vehicle in place, a start passage 32 is also arranged at one end of the upper surface of the platform body. A front wheel pressure plate 33 is arranged in the start passage 32. The front wheel pressure plate 33 is pre-loaded by a spring, so as to avoid a pressure sensor in the front wheel pressure plate 33 from sensing pressure in an initial state. When a front wheel of the vehicle travels to the front wheel pressure plate 33, the front wheel pressure plate 33 overcomes a pretightening force of the spring, and the pressure sensor is pressed, which means that the front wheel pressure plate 33 is started, and a start signal is transmitted to the control system of the three-dimensional parking system 100. A pressed signal of the front wheel pressure plate 33 indicates that the vehicle has been parked in place on the platform body, and the vertical power system 5 *c* be basically directly started to drive the transportation module 8 to lift, so as to transport the vehicle to be parked to an upper space. Further, a start position of the front wheel pressure plate 33 is detected by a roller switch. A contact of the roller switch can be provided to the control system through a sliding contact.

In the present embodiment, the parking platform 3 can adopt four welded assemblies. The assemblies can be stacked, so as to minimize a volume during transportation.

In the present embodiment, the entrance-exit ramp 31 includes two guide rails made of tubular steel. The two guide rails are arranged in parallel to the length direction of the platform body, and are spaced to form the wheel rolling ramp, which are used for protecting vehicle tires and correctly guiding the vehicle onto the platform body. The entrance-exit ramp 31 can be arranged only on one side of the platform body in the length direction thereof, and can also be arranged on both sides simultaneously.

In the present embodiment, the three-dimensional parking system further includes a safety light curtain arranged on the supporting upright column 1. Two safety light curtains are provided. When the transportation module 8 is located on the ground and there is a vehicle to be parked which is driven in the transportation module, the two light curtains respectively illuminate a front end edge and a rear end edge of the parking platform 3, so as to prevent a vehicle head or a vehicle tail from extending beyond the parking platform 3. The safety light curtains are in communication connection with the control system. The safety light curtains are preferably laser sensors which are in communication connection with the control system.

In the present embodiment, the three-dimensional parking system further includes a vehicle height detection sensor arranged on the supporting upright column 1, so as to detect whether a height of the vehicle meets a parking requirement or not. The vehicle height detection sensor is in communication connection with the control system. The vehicle height detection sensor can be a laser sensor.

In the present embodiment, the three-dimensional parking system further includes a bottom sensor arranged at a bottom of the parking platform 3. The bottom sensor is used as a safety device for detecting whether there is an obstacle in a landing area of the parking platform 3 when the parking platform 3 lands to the ground. The bottom sensor is in communication connection with the control system of the three-dimensional parking system 100. The bottom sensor can adopt a laser sensor or a camera.

In the present embodiment, preferably, important parts such as the supporting upright column 1, the parking platform 3, and the platform bracket 4, are all made of steel or light composite materials. The supporting upright column 1 is vertically mounted, and the bottom thereof can be fixed to the ground by way of anchoring. Further, a base can be arranged at the bottom of the supporting upright column 1. The base is fixed to the ground, so as to define a floor area of the three-dimensional parking system 100.

In the present embodiment, in order to facilitate inspection and safety of operators, a safety protective cover is also provided. The safety protective cover is arranged on a periphery of the three-dimensional parking system 100, and a mosaic grid can be used. In addition, a connection point can also be added between the supporting upright column 1 and the mosaic grid, for example, a connecting and fixing structure such as a linkage, is added to further ensure personnel safety.

In the present embodiment, a monitoring device for bottom layer parking area is arranged on the supporting upright column 1, and is used for vehicle entry and exit monitoring, security monitoring, video prevention and control, and the like in a parking area, so as to improve safety performance of a use environment of the parking system. The abovementioned monitoring device for bottom layer parking area is in communication connection with the control system.

In the present embodiment, at least one of a solar charging device, a lighting device, and a billboard is also arranged on supporting upright column 1. In case that the lighting device is arranged at the top of the supporting upright column 1, the overall three-dimensional parking system 100 is shaped like a "street lamp", showing one object has a variety of purposes. The billboard can be a Liquid Crystal Display (LCD) or a Light-Emitting Diode (LED) advertising screen. The solar charging device can supply power to various electrical equipment such as the vertical power system 5 and the rotating power system 6, of the parking system, and meanwhile, facilitates improving energy efficiency of the overall parking system. With the progress and development of society, use of electric vehicles is becoming more and more widespread. In the present embodiment, an electric vehicle charging system, such as the existing charging pile structure, can also be configured in the three-dimensional parking system 100, so as to meet more user requirements.

Further, according to the present embodiment, an enclosure structure can be provided around the overall three-dimensional parking system 100. The enclosure can be a light, non load-bearing, 3D printed structure or a wall panel structure prefabricated by other methods, which is used for enclosing and hiding the three-dimensional parking system 100 therein, so as to effectively hide the three-dimensional parking system 100 out of sight and form an indoor parking system without affecting normal use functions of the parking system. The abovementioned enclosure structure can be square or round. A surface of the enclosure structure can be used for carrying LED information billboards, solar photovoltaic panels, etc.

In the present embodiment, the three-dimensional parking system further includes a client APP. The three-dimensional parking system 100 is provided with a wireless signal module in communication connection with the control system, which can be in wireless communication connection with the client APP such as a hand-held mobile terminal (e.g. a mobile phone) of a client. The control system of the parking system can receive a parking and picking up signal of the hand-held mobile terminal, and schedule the parking platform according to the storing and picking up signal. Taking parking as an example for illustration as follows. A client downloaded a corresponding APP. When he is within a preset parking range (such as 300 m) from the parking system, the client can call through a one-touch parking function in the client APP. At this moment, the control system regulates one of the parking platforms in an idle state to be transferred to the transportation module 8, and then to be carried by the transportation module 8 to the bottom layer parking area (ground) to wait for a vehicle to park. Then, taking picking up as an example for illustration as follows. A client downloaded a corresponding APP. When he is within a preset parking range (such as 300 m) from the parking system, the client calls through a one-touch picking up function in the client APP. At this moment, the control system regulates the parking platform located in the bottom layer parking area to ascend to a layer height where the vehicle to be picked up is located. The layer is rotated in a circumferential direction to transfer the parking platform on which the vehicle to be picked up is parked to the transportation module 8, and is carried to the bottom layer parking area (ground) by the transportation module 8. Besides the abovementioned wireless remote control forms, the client can also park and pick up the vehicle in a card reading mode, which will not be repeated herein.

Further, in order to improve intelligence of the parking system, a mobile payment software system and a parking place reservation function can be set in the client APP. The client can operate on hand-held devices, so as to park and pick up a vehicle quickly and conveniently.

Therefore, the three-dimensional parking system 100 according to the present embodiment, the main body includes a supporting upright column, a power system, and nine parking places. The floor area of the upright column can be less than 1 $m^2$. A modular design facilitates assembly and transportation. The important components, such as the supporting upright column 1, the parking platform 3, and the platform bracket 4, are made from composite materials, such as carbon fiber, so as to realize lightweight. The parking places can be moved interactively by lifting and rotating, thereby enabling the vehicle to be parked and picked up quickly. A charging pile and a solar charging auxiliary system are equipped. One-touch reservation smart parking and mobile payment system are provided. The LED information billboards can be used for advertising, providing traffic information, rolling news, etc. The abovementioned three-dimensional parking system 100 adopts a concept of "street lamp pole" parking system, and through the modular design, an interactive parking mode, low floor area, multi-functional bearing capacity, and safety, urban space can be used for parking efficiently and conveniently, which provides a suitable, multi-functional, and high-tech solution to the problem of parking difficulty in cities at present.

For those skilled in the art, it is obvious that the present disclosure is not limited to the details of the above exemplary embodiments, and can be implemented in other specific forms without departing from the spirit or basic features of the present disclosure. Therefore, from any point of view, the embodiments should be regarded as exemplary but not restrictive. The scope of the present disclosure is limited by the appended claims rather than the above description. Therefore, it is intended to include all changes within the meaning and scope of the equivalent elements of the claims in the present disclosure, and any numeral in the claims shall not be regarded as limiting the claims involved.

In the present disclosure, specific examples are used to illustrate the principle and embodiments of the present disclosure. The description of the above embodiments is only used to help understand the method and core idea of the present disclosure. Meanwhile, for those skilled in the art, changes would be made in the embodiments and application based on the concept of the present disclosure. In conclusion, the content of the present description shall not be construed as a limitation to the present disclosure.

What is claimed is:

1. A three-dimensional parking system, comprising: a supporting upright column (1), an annular railway (2), a parking platform (3), a platform bracket (4), a transportation module (8), a vertical power system (5), a rotating power system (6), and a platform interlocking system, wherein a longitudinal channel (7) extending in an axial direction of the supporting upright column (1) is arranged on the supporting upright column (1), the transportation module (8) is arranged in the longitudinal channel (7), and the vertical power system (5) drives the transportation module (8) to reciprocate up and down along the longitudinal channel (7);

the annular railway (2) is arranged around a periphery of the supporting upright column (1), at least one layer of the annular railway (2) is arranged in the axial direction of the supporting upright column (1), a notch (9) is formed in a position of each layer of the annular railway (2) penetrated by the longitudinal channel (7), and when the transportation module (8) moves to the notch (9) of any layer, the transportation module (8) can form a closed circular ring railway with the annular railway (2) of the current layer;

the platform bracket (4) is movably arranged on the transportation module (8) and each layer of the annular railway (2), and a parking platform (3) is arranged on each of the platform bracket (4), the rotating power system (6) drives the platform bracket (4) to move on the closed circular ring railway, so as to realize position displacement of the platform bracket (4) between the transportation module (8) and the annular railway (2) of the current layer;

the platform interlocking system comprises a pushing mechanism and a locking mechanism (10), each locking mechanism (10) is arranged at a position of each layer of the annular railway (2) close to the notch (9), and the locking mechanism (10) on the annular railway (2) where the transportation module (8) does not stay is in a locked position, so as to lock the platform bracket (4) on the annular railway (2) of the current layer;

each platform bracket (4) is configured with the pushing mechanism; and when the transportation module (8) moves to the notch (9) of any layer and forms the closed circular ring railway, the pushing mechanism drives the platform bracket (4) on the transportation module (8) to be in a force application position, so as to trigger the locking mechanism (10) and enable the locking mechanism (10) to unlock the platform bracket (4) on the annular railway (2) of the current layer;

each layer of the locking mechanism (10) comprises:

a locking rod, wherein a middle part of the locking rod is hinged to the annular railway (2), one end of the locking rod is provided with a boss which can prevent the platform bracket from moving along the annular railway (2), and the other end thereof is provided with an unlocking part which is configured to be pressed in a contact manner by the platform bracket (4) on the transportation module (8); and a return spring, wherein the return spring is arranged between the locking rod and the annular railway (2), and can maintain a locking state of the boss to the platform bracket (4), and after the unlocking part is pressed in a contact manner by the platform bracket (4), the locking state is released.

2. The three-dimensional parking system according to claim 1, wherein each layer of the locking mechanism (10) is provided with a state sensor, and the state sensor is in a communication connection with a control system of the three-dimensional parking system to monitor a working state of the locking mechanism in real time.

3. The three-dimensional parking system according to claim 1, wherein each layer of the annular railway (2) comprises an upper annular rail and a lower annular rail (21) located below the upper annular rail, the transportation module (8) comprises an upper annular rail for complementing notch (82) and a lower support block (81);

the upper annular rail for complementing notch (82) is configured to butt with the upper annular rail of any layer to form an upper closed circular ring rail; on the transportation module (8), a top of the platform bracket (4) is hinged slidably to the upper annular rail for complementing notch (82), and on the annular railway (2), the top of the platform bracket (4) is hinged slidably to the upper annular rail;

the lower support block (81) is configured to butt with the lower annular rail (21) of any layer to form a lower closed circular ring rail, and the upper closed circular ring rail and the lower closed circular ring rail form the closed circular ring railway together; and the lower support block (81) is configured for installing the pushing mechanism and/or the rotating power system (6).

4. The three-dimensional parking system according to claim 3, wherein on the transportation module (8), the top of each platform bracket (4) is mounted slidably on the upper annular rail for complementing notch (82) through a slider, and the top of the platform bracket (4) is hinged to the slider; and on the annular railway (2), the top of the platform bracket (4) is mounted slidably on the annular rail through a slider, and the top of the platform bracket (4) is hinged to the slider.

5. The three-dimensional parking system according to claim 3, wherein a guide wheel block (11) which can be fitted with the lower closed circular ring rail is arranged at a bottom or a middle part of each platform bracket (4).

6. The three-dimensional parking system according to claim 3, wherein the rotating power system (6) comprises:

annular ring gears (61), wherein the annular ring gears (61) are fixedly mounted on the platform brackets (4), when the closed circular ring railway is formed, the annular ring gears (61) on all the platform brackets (4) of the current layer are sequentially butted end to end to form a closed circular ring gear;

a driving gear (62), wherein the driving gear (62) is arranged on the lower support block (81) or the lower annular rail (21), and is engaged with the closed circular ring gear, so as to drive the platform bracket (4) to perform position displacement between the transportation module (8) and the annular railway (2) on the current layer; and a rotation driving mechanism (63), wherein the rotation driving mechanism (63) is connected to the driving gear (62), so as to drive the driving gear (62) to rotate.

7. The three-dimensional parking system according to claim 6, wherein the pushing mechanism comprises at least one pushing hydraulic cylinder (12), the pushing hydraulic cylinder (12) comprises a cylinder body and a cylinder rod, one of the cylinder body or the cylinder rod is connected to the annular ring gear (61), and the other thereof is connected to the bottom or the middle part of the platform bracket (4); and the pushing hydraulic cylinder (12) can push the platform bracket (4) to rotate in a direction away from the supporting upright column (1) around a hinged position of the top thereof.

8. The three-dimensional parking system according to claim 6, wherein the rotation driving mechanism (63) is a driving electric motor or a driving motor.

9. The three-dimensional parking system according to claim 1, wherein the longitudinal channel (7) is provided with a lifting guide rail extending in an axial direction of longitudinal channel (7) therein; and the transportation module (8) is slidably connected to the lifting guide rail.

10. The three-dimensional parking system according to claim 1, wherein the vertical power system (5) comprises a power driving mechanism (51) and a power transmission chain (52), and one end of the power transmission chain (52) is connected to the power driving mechanism (51), and the other end thereof is connected to the transportation module (8).

11. The three-dimensional parking system according to claim 10, wherein the power driving mechanism (51) is a lifting electric motor or a winch.

12. The three-dimensional parking system according to claim 10, wherein a machine room for accommodating the power driving mechanism is arranged at the top of the supporting upright column (1).

13. The three-dimensional parking system according to claim 1, wherein the platform bracket (4) is an L-shaped bracket which comprises a vertical connecting rod and a horizontal supporting rod, a top of the vertical connecting rod is connected to the transportation module (8), and a bottom thereof is connected to one end of the horizontal supporting rod, and the horizontal supporting rod is connected to the parking platform (3).

14. The three-dimensional parking system according to claim 1, wherein the parking platform (3) comprises:

a platform body;

an entrance-exit ramp (31), wherein the entrance-exit ramp (31) is arranged on an upper surface of the platform body, and the entrance-exit ramp (31) extends in a length direction of the platform body and is configured for guiding a vehicle to enter and exit the platform body;

a start passage (32), wherein the start passage (32) is arranged at one end of the upper surface of the platform body, a front wheel pressure plate (33) is arranged in the start passage (32), and the front wheel pressure plate (33) is connected to an interior of the start passage (32) through a spring; and when a front wheel of the vehicle travels to the front wheel pressure plate (33), the front wheel pressure plate (33) is started, and a signal is transmitted to a control system of the three-dimensional parking system.

15. The three-dimensional parking system according to claim 14, further comprising two safety light curtains arranged on the supporting upright column (1); when the transportation module (8) is located on the ground and there is a vehicle to be parked which is driven in the transportation module, the two light curtains respectively illuminate a front end edge and a rear end edge of the parking platform (3), so as to prevent a vehicle head or a vehicle tail from extending beyond the parking platform (3); and the safety light curtains are in communication connection with the control system.

16. The three-dimensional parking system according to claim 14, further comprising a vehicle height detection sensor arranged on the supporting upright column (1); and the vehicle height detection sensor is in communication connection with the control system.

17. The three-dimensional parking system according to claim 1, further comprising a bottom sensor arranged at a bottom of the parking platform (3), the bottom sensor is configured for detecting whether there is an obstacle in a landing area of the parking platform (3) when the parking platform (3) lands to the ground; and the bottom sensor is in communication connection with the control system of the three-dimensional parking system.

18. The three-dimensional parking system according to claim 1, further comprising a safety protective cover, wherein the safety protective cover is arranged on a periphery of the three-dimensional parking system.

19. The three-dimensional parking system according to claim 1, wherein at least one of a solar charging device, a lighting device, and a billboard is also arranged on the supporting upright column (1).

* * * * *